US005451139A

United States Patent [19]

Tadiello

[11] Patent Number: 5,451,139

[45] Date of Patent: Sep. 19, 1995

[54] SELF PRIMING CENTRIFUGAL

[75] Inventor: Armando Tadiello, Montebello, Italy

[73] Assignee: Ebara Corporation, Tokyo, Japan

[21] Appl. No.: 346,585

[22] Filed: Nov. 16, 1994

Related U.S. Application Data

[63] Continuation of Ser. No. 7,078, Jan. 21, 1993, abandoned.

[30] Foreign Application Priority Data

Jan. 24, 1992 [IT] Italy ..... VI92U0004

[51] Int. Cl.[6] ..... F01D 1/08; F03B 11/00

[52] U.S. Cl. ..... 415/56.5; 415/208.1; 415/211.1; 417/83; 417/89

[58] Field of Search ..... 415/208.1, 211.1, 211.2, 415/56.5; 417/83, 89, 423.1

[56] References Cited

U.S. PATENT DOCUMENTS

| | | | |
|---|---|---|---|
| 2,264,953 | 12/1941 | Regar | 417/83 |
| 2,524,770 | 10/1950 | Conery . | |
| 2,850,984 | 9/1958 | Shiley et al. | 417/83 |
| 2,938,471 | 5/1960 | Jacuzzi | 417/83 |
| 2,941,474 | 6/1960 | Hall | 417/83 |
| 3,148,464 | 9/1964 | Jones | 415/211.2 |
| 5,100,289 | 3/1992 | Caoduro | 415/56.5 |

FOREIGN PATENT DOCUMENTS

| | | |
|---|---|---|
| 0323384 | 12/1988 | . |
| 0401670 | 12/1990 | European Pat. Off. . |
| 0406787 | 1/1991 | European Pat. Off. . |
| 2650864 | 2/1991 | France . |

*Primary Examiner*—Richard A. Bertsch
*Assistant Examiner*—Roland G. McAndrews, Jr.
*Attorney, Agent, or Firm*—Greenfield & Sacks

[57] ABSTRACT

A self-priming centrifugal pump includes a cylindrical metal plate case forming a pressure chamber and provided with a suction inlet and a pressure outlet. The pressure chamber has a bladed impeller with a peripherally arranged diffuser, an axial ejector device including a venturi tube, and a torus-shaped interspace adapted to convey the emitted flow from the radial diffuser towards the pressure chamber. A single curved blade is arranged in the lower portion of the interspace and extends from the peripheral region of the radial diffuser up to a central annular outlet passage of the interspace which extends all around said ejector device in such a manner to counteract the rotational component of the fluid speed direction and to promote separation of air.

31 Claims, 1 Drawing Sheet

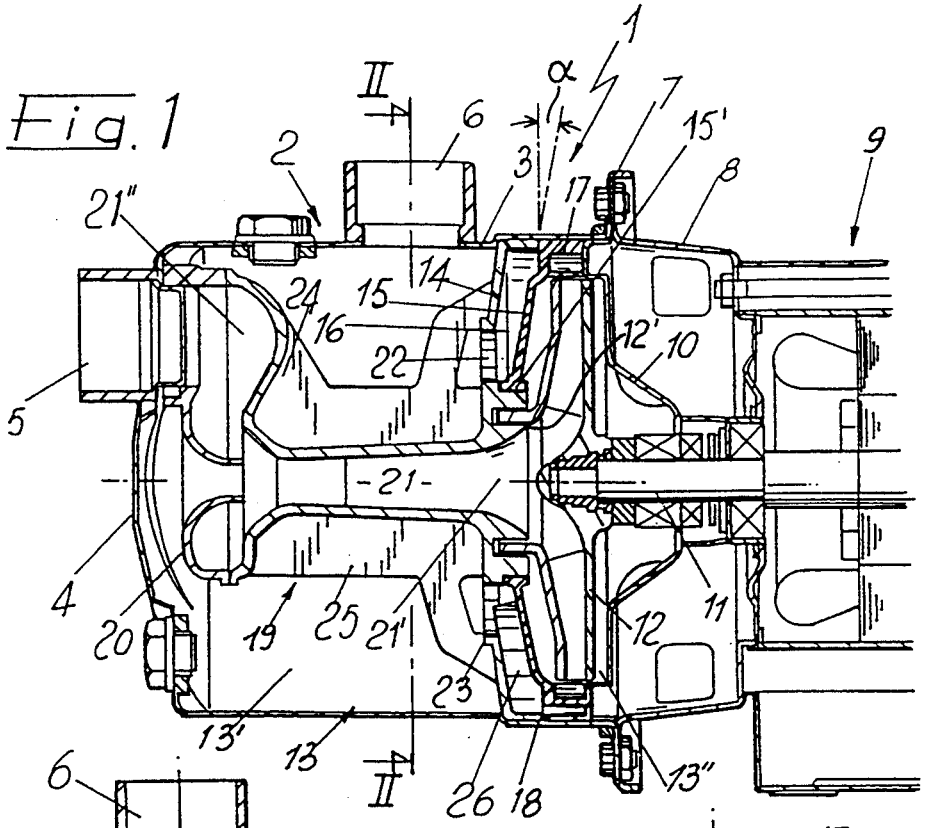
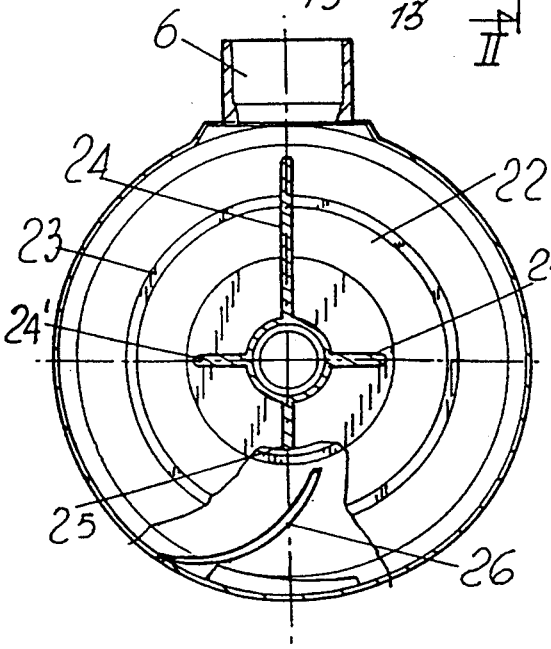
Fig. 2
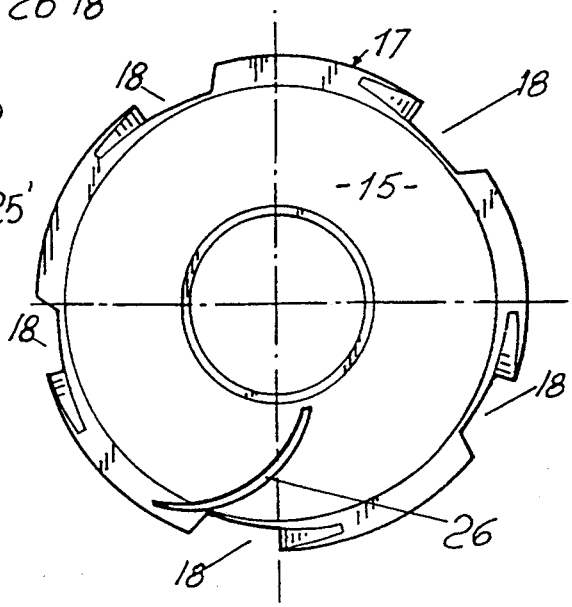
Fig. 3

SELF PRIMING CENTRIFUGAL

This application is a continuation of application Ser. No. 08/007,078, filed Jan. 21, 1993, now abandoned.

BACKGROUND OF THE INVENTION

1. Field of the Invention

The present invention relates to a self priming centrifugal pump comprising a metal plate case with a substantially cylindrical shape defining internally thereof a pressure chamber with an inlet port and an outlet port, within this pressure chamber a rotatable impeller and a radial diffuser being arranged at an axial end thereof, an axial ejector device being located at the opposite axial end thereof, and an intermediate torus-shaped interspace being arranged in an intermediate position to direct the outlet flow issued by the radial diffuser backwards to the pressure chamber.

2. Description of the Prior Art

In the known pumps as above, the flow emitted by the diffuser and accelerated by the impeller has an outlet speed with a high rotational component. Thus, most of the air trapped in the pumped fluid is directed to the pressure chamber and passes through the ejector several times before being discharged through the outlet port, thereby lengthening the priming times of the pump. U.S. Pat. No. 2,941,474 discloses a centrifugal pump having a torus-shaped interspace which forms a vortex chamber with an annular central opening extending around the periphery of the ejector. The trapped air present in the fluid subjected to a swirling action and is finally discharged through the outlet port in the pressure chamber without being previously separated. This arrangement is inadequate and does not afford significant reduction of the priming times.

The pumping apparatus described in the British Patent No. 1.201.721 and in the Italian Patent Application No. 85605 A/89 comprises an interspace which is provided with a plurality of substantially radial blades adapted to counteract the rotational component of the fluid flow thereby promoting separation of air. Similarly the reconvey interspace applied to the pump described in the Italian Patent No. 1.225.597 is provided with a number of substantially radial blades which form recirculator channels, however this pump makes use of an axial diffuser which is arranged to face the impeller on the low pressure side thereof, and therefore the flow entering the recirculator channels has a speed direction with a relatively high rotational component. Moreover, the structure of these latter pumps is excessively complicated and brings about remarkable fluidodynamic losses.

The self priming centrifugal pumps known from the German Patent No. 3718273 and the European Patent No. 0323384 have an interspace with a single blade that offers the advantage of a lower complexity and reduced frictional losses. However, such interspace has a wall with one or more outlets for the fluid with relatively limited sizes which are located only in the upper half of the interspace wall. Thus, the trapped air tends to swirl and to be retained into the interspace thus elongating the priming times and reducing the efficiency of the pump.

One aim of the present invention is to eliminate the above mentioned drawbacks by providing a self priming centrifugal pump incorporating an eject, or which is capable of operating with high efficiency arid is very simple in structure.

SUMMARY OF THE INVENTION

This aim, these objects and others, which will become apparent to those skilled in the art, are achieved by a centrifugal pump as above characterized in that a single curved blade is provided in the lower portion of the torus-shaped interspace, such blade extending from the outer periphery of the radial diffuser up to an annular passage of the interspace located around the ejector device.

Advantageously, the interspace is substantially funnel-shaped and is formed by a pair of substantially frustoconical and parallel walls extending inwardly with a conicity oriented towards the end of the case in the vicinity of the venturi tube.

Due to the presence of the single blade having a curved and smoothened shape, the rotational speed component of the fluid is effectively counteracted thus reducing the fluidodynamic losses. Moreover, because of the conical shape of the interspace and of the size of the annular passage, the air-liquid solution is not retained within the interspace and is promptly discharged through the outlet port.

Experimental tests have shown that the pump according to the invention achieves the stated objects insofar as it sets forth reduced priming times as well as a high fluidic efficiency. Additionally the pump has a relatively simple and inexpensive construction.

Further characteristics and advantages of the invention will become apparent from a reading of the detailed description of a preferred but not exclusive embodiment of a self priming centrifugal pump according to the invention, illustrated only by way of a non-limiting example in the accompanying drawings.

BRIEF DESCRIPTION OF THE DRAWINGS

FIG. 1 is a partially sectioned side view of the pump according to the invention;

FIG. 2 is a cross-section view taken along the vertical plane II—II of FIG. 1;

FIG. 3 is a front view of the detail having the reference numeral 15 in FIG. 1

DESCRIPTION OF THE PREFERRED EMBODIMENTS OF THE INVENTION

With reference to the figures, the pump, generally indicated by numeral 1, comprises a case 2 made of a metal plate with a lateral wall 3 of substantially cylindrical shape and with a slightly outwardly bulged bottom wall 4. These walls are provided with inlet port 5 and outlet port 6 respectively which mount corresponding nozzles for connection with suction and pressure tubes.

The end portion of the case remote from the bottom wall 4 shows a connecting flange 7 for connection with a support 8 of an electric motor 9. A fluid-tight partition wall 10 is interposed between the flange 7 and the support 8 and is centrally provided with bearings and wear rings mounted on the shaft 11 of the motor 9, and a bladed impeller 12 rigidly fixed to the end portion thereof.

A pressure chamber 13 is formed in the inner space of the case 2 between the lateral wall 3, the bottom wall 4 and the partition wall 10 to collect the pressurized fluid. A pair of walls 14, 15 of substantially frusto-conical shape are axially spaced to partition the pressure chamber 13 into sub-chambers 13' and 13'', so as to form therein a funnel shaped interspace 16. The walls 14, 15 lave all angle of conicity $\alpha$ ranging between 5° and 20° according to the wished axial acceleration of the fluid. The conicity angle $\alpha$ is preferably set at 10°.

The impeller 12 is rotatably supported within the sub-chamber 13'' and is encircled by a radial diffuser 17 having front apertures 18 adapted to impart to the fluid a minimum axial speed directed towards the sub-chamber 13'.

Moreover, a conventional ejector device 19 is arranged in the sub-chamber 13' in substantially central position, such device comprising a venturi tube 20 adapted to supply a diffusion duct 21 which is, in turn, connected at one end thereof 21'' with a suction port 5 and, at the opposite end 21', with the suction eye 12' of the impeller 12.

Preferably, the frusto-conical wall 15 is unitary with the radial diffuser 17 and has a central portion 15' for supporting the end 21' of the diffusion duct 21.

The frusto-conical wall 14 shows a central annular passage 22 provided with an outer collar 23 which forms a discharge aperture for the interspace 16, which aperture extends peripherally to the diffuser over 360°.

Advantageously, the frusto-conical wall 14 may be unitary with the outer wall of the diffusion duct 21 and is joined to this latter by means of a pair of webs 24, 25 extending in a vertical axial plane.

Alternatively, a second pair of webs 24', 25' may be provided in a substantially perpendicular plane to the first pair 24, 25. These webs have the ancillary function of aligning the outlet flow issued by the impeller through the central annular passage 22, to thereby promote regular feeding of the Venturi tube separation of air bubbles.

According to the invention, a single blade 26 is located in the interspace 16. Blade 26 is slightly curved to counteract the rotational speed component of the fluid leaving the diffuser 17 and to entirely direct it towards the annular passage 22. More particularly, the blade 26 has a profile with an upper concavity and is disposed in the lower portion of the interspace 16 and extends from the outer periphery of the diffuser 17 up to the central area 15' of the partition wall 15 in correspondence of the outlet 22, to thereby upwardly direct the fluid containing the bubbles of air.

Thus, the fluid issued by the impeller is collected and pressurized by the diffuser 17, is further directed to the interspace 16 reducing its rotational speed component and finally is discharged in the sub-chamber 13'' the fluid is completely deprived of rotational speed component and is smoothened by the longitudinal webs 24, 25. Because of this smoothing action, the trapped air in the fluid flows upward towards the outlet port, so that the venturi tube is supplied in few seconds by air-free fluid.

The pump according to the invention is susceptible to numerous modifications and variations, all of which are within the scope of the inventive concept. All the details may furthermore be replaced with other technically equivalent elements.

In practice, the materials employed, as well as the dimensions, may be any according to the requirements.

Having thus described one particular embodiment of the invention, various alterations, modifications, and improvements will readily occur to those skilled in the art. Such alterations, modifications, and improvements as are made obvious by this disclosure are intended to be part of this disclosure though not expressly stated herein, and are intended to be within the spirit and scope of the invention. Accordingly, the foregoing description is by way of example only and is not intended as limiting. The invention is limited only as defined in the following claims and the equivalents thereto.

What I claim is:

1. A self-priming centrifugal pump comprising a case of substantially cylindrical shape forming a pressure chamber and including a suction inlet and a pressure outlet, said pressure chamber having a substantially horizontal central axis aligned in a direction along a midpoint of a diameter of the case, said pressure chamber housing a bladed impeller with a peripherally-arranged diffuser having outlet apertures, an axial ejector device including a venturi tube, and a substantially torus-shaped interspace adapted to convey fluid from the outlet apertures of said radial diffuser towards the pressure chamber, said interspace extending around said ejector device and defining an annular passage having an inner diameter and an outer diameter, and a single curved blade located in the interspace and disposed below the central axis of the pressure chamber, said blade having a profile with an upper concavity extending from a peripheral region of the radial diffuser proximate to a lowest point thereof up to a location of said annular passage intermediate in such a manner to counteract a rotational motion of the fluid and to upwardly direct the fluid from the interspace toward the outlet port.

2. The pump according to claim 1, wherein the ejector device is joined to one of the pair of the frusto-conical walls of said interspace by means of at least one pair of diametrical webs constructed and arranged to align an outlet flow of the fluid issued by the bladed impeller towards the venturi tube of the ejector device.

3. The pump according to claim 1, wherein said interspace is substantially funnel-shaped.

4. The pump according to claim 3, wherein said interspace is formed by a pair of substantially frusto-conical walls which are coaxially spaced and extend from a peripheral region to the center of said chamber, the frustro-conical walls having an angle of conicity measured from a vertical axis.

5. The pump according to claim 4, wherein said angle of conicity of the pair of frusto-conical walls of said interspace is between a range of 5° and 20°.

6. The pump according to claim 4, wherein the radial diffuser is unitary with one of the pair of frusto-conical walls of said interspace.

7. The pump according to claim 6, wherein said apertures of the diffuser encircle the impeller so that a rotational speed component of the fluid is minimized.

8. A self-priming centrifugal pump comprising:

a case including an outer wall and first and second ends so as to define an outer chamber, each end having a center, the case further having a cylindrical shape and a substantially horizontal central axis extending from the center of the first end to the center of the second end;

an outlet port disposed on the outer wall of the case and above the central axis, the outlet port defining a top of the pump and being constructed and arranged to permit fluid to exit the pump;

an inlet port disposed at the first end of the case, the inlet port being constructed and arranged to permit fluid to enter the pump;

an inner wall extending along the central axis so as to define an inner chamber;

an ejector member interconnected between the inlet port and the inner wall;

an impeller housed within the inner chamber and disposed at the second end of the case, the impeller having a center aligned with the center axis of the case;

a diffuser encircling a portion of the impeller; and an interspace having a single blade and defining an annular passage having an inner diameter and an outer diameter, wherein the interspace is disposed between the outer chamber and the inner chamber, and the blade is disposed below the central axis and has a profile with an upper concavity extending from a peripheral region of the diffuser proximate to a lowest point thereof to a location intermediate of said annular passage, the blade being constructed and arranged to direct the fluid from the interspace to the outer chamber in an upward direction proximate to the outlet port.

9. The pump of claim 8, wherein fluid flowing into the interspace has a rotational speed, and the blade is constructed and arranged to reduce the rotational speed.

10. The pump of claim 8, wherein the diffuser includes a plurality of apertures constructed and arranged to permit fluid to pass from the inner chamber into the interspace.

11. The pump of claim 8, wherein the interspace is substantially funnel-shaped.

12. The pump of claim 11, further including first and second frusto-conical walls defining the interspace, the first and second walls extending from the outer wall in a direction towards the ejector and having an angle of conicity between 5° and 20° from a vertical axis.

13. The pump of claim 12, wherein the diffuser is unitary with one of the first and second frusto-conical walls.

14. The pump of claim 12, wherein the first and second frusto-conical walls define an annular shaped passage between the interspace and the outer chamber.

15. The pump of claim 14, wherein the annular shaped passage extends 360° around the central axis.

16. The pump of claim 8, wherein the ejector member includes at least one pair of webs constructed and arranged to reduce a rotational speed of the fluid so that air bubbles are separated from the fluid.

17. The pump of claim 16, wherein the at least one pair of webs includes first and second diametrically positioned webs.

18. The pump of claim 17, wherein the inner wall has an outer surface, and the at least one pair of webs extend from the outer surface of the inner wall into the outer chamber.

19. The pump of claim 18, wherein a first pair of the at least one pair of webs extends in a substantially vertical direction.

20. The pump of claim 19, wherein a second pair of the at least one pair of webs extends in a substantially horizontal direction.

21. A self-priming centrifugal pump comprising:

a case including an outer wall and first and second ends so as to define an outer chamber, each end having a center, the case further having a cylindrical shape and a substantially horizontal central axis extending from the center of the first end to the center of the second end;

an outlet port disposed on the outer wall of the case, the outlet port being constructed and arranged to permit fluid to exit the pump;

an inlet port disposed at the first end of the case, the inlet port being constructed and arranged to permit fluid to enter the pump;

an inner wall having an outer surface extending along the central axis so as to define an inner chamber;

an ejector member interconnected between the inlet port and the inner wall;

an impeller housed within the inner chamber and disposed at the second end of the case, the impeller having a center aligned with the center axis of the case;

a diffuser encircling a portion of the impeller;

an interspace disposed between the outer chamber and the inner chamber and defining an annular passage having an inner diameter and an outer diameter; and a single blade disposed within the interspace and having a profile with an upper concavity extending from an outer region of the diffuser proximate to a lowest point thereof to a location of said annular passage.

22. The pump of claim 21, wherein fluid flowing into the interspace has a rotational speed, and the blade is constructed and arranged to reduce the rotational speed.

23. The pump of claim 21, wherein the diffuser includes a plurality of apertures constructed and arranged to permit fluid to pass from the inner chamber into the interspace.

24. The pump of claim 21, wherein the ejector member includes at least one pair of diametrically positioned webs extending from the outer surface of the inner wall into the outer chamber to reduce a rotational speed of the fluid, and wherein a first pair of the at least one pair of webs extends in a substantially vertical direction.

25. The pump of claim 24, wherein a second pair of the at least one pair of webs extends in a substantially horizontal direction.

26. The pump of claim 22, wherein the blade is disposed below the central axis, and the outlet port is disposed above the central axis.

27. The pump of claim 21, wherein the interspace is substantially funnel-shaped.

28. The pump of claim 27, further including first and second frusto-conical wails defining the interspace, the first and second walls extending from the outer wall in a direction towards the ejector and having an angle of conicity between 5° and 20° from a vertical axis.

29. The pump of claim 28, wherein the diffuser is unitary with one of the first and second frusto-conical walls.

30. The pump of claim 28, wherein the first and second frusto-conical walls define an annular shaped passage between the interspace and the outer chamber.

31. The pump of claim 30, wherein the annular shaped passage extends 360° around the central axis.

* * * * *

UNITED STATES PATENT AND TRADEMARK OFFICE

CERTIFICATE OF CORRECTION

PATENT NO. : 5,451,139

DATED : September 19, 1995

INVENTOR(S) : Armando TADIELLO

It is certified that error appears in the above-indentified patent and that said Letters Patent is hereby corrected as shown below:

On the title page, item [54] and column 1, line 2, change the title to --SELF PRIMING CENTRIFUGAL PUMP--

Column 2, line 2 should read --capable of operating with high efficiency and is very--

Signed and Sealed this

Second Day of April, 1996

Bruce Lehman

*Attest:*

BRUCE LEHMAN

*Attesting Officer*

*Commissioner of Patents and Trademarks*